United States Patent [19]

Thorn et al.

[11] 4,081,638

[45] Mar. 28, 1978

[54] LEVEL CONTROL WITH FLOAT ACTUATED SWITCH

[75] Inventors: William B. Thorn, Parkersburg, W. Va.; Jonathan G. Tobelmann, Corning, N.Y.

[73] Assignee: Corning Glass Works, Corning, N.Y.

[21] Appl. No.: 735,372

[22] Filed: Oct. 26, 1976

[51] Int. Cl.[2] ..... H01H 35/18

[52] U.S. Cl. ..... 200/84 R; 73/308; 73/322.5

[58] Field of Search ..... 200/84 R, 61.2; 73/403, 73/308, 311, 319, 322.5; 340/244 A

[56] References Cited

U.S. PATENT DOCUMENTS

| | | | |
|---|---|---|---|
| 2,510,663 | 6/1950 | Schuessler | 73/311 |
| 2,736,013 | 2/1956 | Binford | 73/311 |

*Primary Examiner*—Gerald P. Tolin

*Attorney, Agent, or Firm*—Burton R. Turner; Clarence R. Patty, Jr.

[57] ABSTRACT

A float unit having two float portions operates a switching unit to stop the supply of liquid at a selected high level and to reestablish the supply at a selected low level. The switching unit may be a precision snap-acting switch, and the float unit may be integrally formed from glass. In the preferred embodiment, the switch and an upper switch-engaging portion of the float are mounted in a housing which serves as a closure for a container.

10 Claims, 1 Drawing Figure

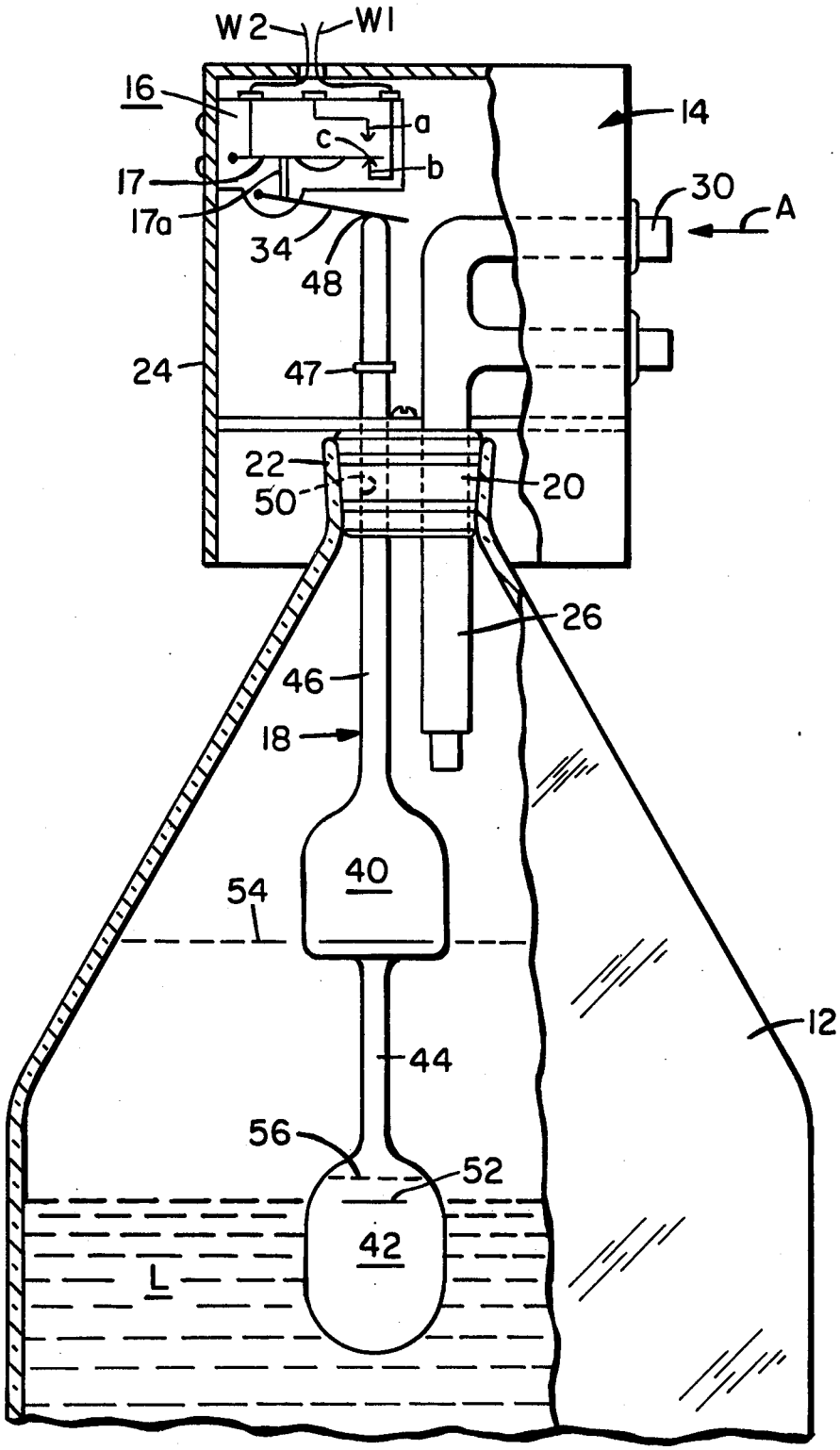
W2
W1
16
14
a
c
b
17
17a
30
A
34
48
24
47
22
50
20
26
46
18
40
54
12
44
56
52
42
L

LEVEL CONTROL WITH FLOAT ACTUATED SWITCH

BACKGROUND OF THE INVENTION

The present invention generally relates to liquid level sensing devices which utilize float means, and more particularly to a multiple liquid level sensing device utilizing two interconnected float portions to actuate the opening and closing of contacts in a mechanical switch, wherein the opening and closing of the contacts is predetermined by the vertical distance between the float portions and the contour of such floats.

Prior known multiple liquid level detection systems have employed magnetic reed switches in conjunction with a single float having two magnets incorporated into an upright shaft extending from an upper end of the float. An upper magnet actuated the shutoff of the supply of liquid as the float moved upwardly in such liquid, while a lower magnet reactivated the supply of such liquid when the float moved downwardly with the liquid level.

This known type of detection system required careful regulation, expensive relay and power supply circuitry, and careful handling to prevent damage to the fragile reed switch. Furthermore, the provision of the upper end of the float with the magnets requires a relatively difficult manufacturing operation.

It is the primry object of the present invention to provide a multiple liquid level detector which eliminates concern about the foregoing shortcomings.

SUMMARY OF THE INVENTION

The level control of the present invention includes a switching unit or device positioned within an upper closure or housing, and a float unit or assembly suspended in the liquid and adapted to apply force to the actuation mechanism of the switching device. The actuation mechanism of the switching device includes snap-action means which, upon the application of a selected operating force, opens the switch contacts and holds such contacts open until the force applied thereto decreases to a selected amount, hereinafter referred to as the release force, whereupon the contacts revert back to their normally closed position. The float assembly includes a lower float portion, an upper float portion connected to the lower float portion, and an upright arm or shaft extending from the upper float portion for engaging the actuation mechanism. The two float portions have selected volumes such that the lower float portion supports the total weight of the assembly and causes the float unit to be buoyant in the liquid, while the upper float portion causes the unit to apply an added incremental amount of force against the actuation mechanism which, with the buoyant force of the lower float, is at least equal to the operating force necessary to actuate the snap-action means. The vertical distance between the float portions determines the difference in the preselected high and low liquid levels to be monitored or controlled.

The level control of this invention is particularly useful in regulating the supply of liquid to a bottle dispenser from an electrically powered water distillation apparatus. The bottle dispenser has a neck through which the float unit extends and a housing removably mounted on the neck. The arm of the float unit and the switching unit are supported within the housing, such that the arm will rise against the actuator of the switching unit. The switch activates or energizes a relay within the power supply of the distillation apparatus to turn off the power supply when the liquid ascends to a selected high level in the bottle dispenser. As water is drained, the liquid eventually subsides to a selected low level, thereby energizing the relay and consequently the supply of distilled water from the distillation device.

BRIEF DESCRIPTION OF THE DRAWING

The drawing is a somewhat schematic elevational view partially in section of the liquid level control apparatus of the present invention, as employed in a liquid collection and dispensing system, wherein the float and switch units which comprise the main elements of the control system are mounted in a housing which serves as a closure for the neck of a bottle or container.

DESCRIPTION OF THE PREFERRED EMBODIMENTS

Referring now to the drawing, the level control apparatus of the present invention is shown in a particular preferred combination with a liquid collection and dispensing container or bottle 12. The level control apparatus is shown including a housing 14, a switching unit or device 16, and a float assembly 18 mounted for operation in the housing 14. The housing 14 has a plug member 20 removably engaged in the neck 22 of the bottle and a cover member or outer shell 24 which protects the level control from mishandling. The housing 14 thus not only supports the level control parts, but also prevents contamination of the liquid L within the container 12.

The container 12 has a spigot or valve, which is not illustrated, at its lower end for selectively withdrawing the liquid L from the container. The liquid is supplied through a piping circuit 26 fitted within a bore formed in the plug member 20. The illustrated piping circuit 26 is of a well-known construction which includes an inner venting tube and an outer liquid supply tube coaxial with the venting tube. The piping circuit 26 communicates with an electrically powered source of liquid by conduit 30, with the flow of such liquid indicated by arrow A.

The liquid source may, for example, be a water distillation apparatus having a typical power control circuit including a relay for controlling the flow of liquid, which is connected to the switching unit 16. When energized by the switching unit, the power control circuit in such apparatus may activate, among other things, an electrical water heater in the still to vaporize water which is condensed and fed to the container 12. Electrical stills which are compatible with the present level control are, for example, the AG model stills sold by Corning Glass Works. Although such stills form no part of the present invention, the level control hereof, when utilized in combination with such stills, provides a completely automatic water distillation device.

The switching unit or switch device 16 is preferably a precision snap-action mechanical switch which has a movable contact *c* and two poles or fixed contacts *a* and *b*, and an actuation mechanism or actuator 17 which requires the application of a selected amount of force to open the contacts from their normally closed position *b-c*, and which maintains the movable contact *c* in its open position *a-c* as long as the force applied thereto exceeds a selected amount of force, which is less than required to open the contacts. As previously mentioned, the amount of force required to open the contacts is referred to as the operating force, and the force required to keep the contacts from closing is called the release force. Such terms are defined with greater detail in Micro Switch Catalog 50, Issue K, entitled "Precision Switches and Industrial Control Devices" distributed by the Micro Switch Division of Honeywell.

A specific example of a snap-action switch which may be utilized with the float assembly 18 is the Micro Switch Catalog No. BZ-2RW863-A2 Standard Basic Switch, which is a single-pole double-throw switch. The switch has an actuator lever 34 which transfers motion through a depressible plunger 17*a* to operate the actuation mechanism 17. One lead wire W1, of the switch 16 is connected to the normally closed terminal *b*, and the other lead wire W2 is attached to the movable common terminal *c*. That is, the switch 16 may be connected to make a complete circuit in the normally closed contact position *b-c*, and to break the circuit after application of the operating force on the switch actutor 17 has moved the contacts to their open position *a-c*.

The float assembly 18 includes upper and lower floats or float portions 40 and 42, respectively. The floats 40 and 42 are vertically spaced apart by an interconnecting shaft 44, and the upper end of upper float 40 is connected to a switch actuating shaft or arm 46. Preferably, the floats 40 and 42, shaft 44 and arm 46 are generally symmetrical about a common axis, thereby permitting the float unit 18 to be inserted within container 12 through the bottle neck 22. The unit 18 may be integrally constructed from a material which is inert to the liquid, such as Corning Glass Works Code 7740 borosilicate glass.

In the example shown in the drawing, the lower float 42 has rounded or generally spherical lower and upper ends and a cylindrical sidewall. The interconnecting shaft 44 is a cylindrical tube fused to the central portions of the lower and upper floats. The upper float 40 has a flat bottom surface portion and a generally cylindrical sidewall extending upwardly therefrom. The switch actuating shaft 46 is also formed from glass tubing, and is joined at its lower end to the center of upper end of the upper float 42 and is sealed or closed at its upper end 48.

The shaft 46 of the float unit is inserted through a vertically disposed bore 50 in the plug portion 20 of the housing 14 and a resilient gasket or ring 47 is slipped over the arm 46 at a selected position to limit the downward movement of the float assembly. The float unit 18 is free to move vertically upwardly and downwardly through the bore in the plug 20, depending upon the level of the liquid L in the container 12. The switch 16 is rigidly mounted above the float unit 18 with the actuator lever 34 of the switch 16 aligned above the upper end 48 of the switch actuating shaft 46. When the container is empty or below a predetermined low liquid level, the upper end 48 is preferably not in contact with the switch actuator lever 34.

After liquid has been supplied through the circuit 26 and the liquid level has risen to contact the float unit 18, the float unit will be buoyed or suspended in the liquid L in a partially submerged condition. The lower float portion 42 has a volume which will cause the float unit 18 to be suspended or float in the liquid L when the liquid level registers with a height 52 above the lower end of the lower float, as shown in the drawing. The ring or stop 47 prevents the float unit 18 from falling through the plug 20 when the liquid level in the container 12 is quite low, and as the liquid level rises in the container and encompasses the float portion 42 up to a height 52, the float unit 18 will float up with the rising liquid.

As the float assembly 18 rises with the rising liquid level, the upper end 48 of the switch actuating shaft 46 contacts actuator lever 34 which stops further upward movement of the float unit 18 and applies a force against its upper end 48. The liquid L then continues up to the connecting shaft 44, relative to the float unit. The shaft 44 displaces a small volume of liquid and is adapted to exert less force than required to actuate the switch. The lower end of the upper float 40, on the other hand, presents a large surface area or volume of displacement. Accordingly, when the liquid rises and impinges the lower end of the upper float portion 40, the incremental buoyant forces added by the upper float portion 40 will, through the upper end 48 of switch actuating shaft 46 acting on actuator lever 34 to depress movable plunger 17*a* and operate the actuation mechanism 17, snap open the normally closed switch contacts *b-c* to the switch-open position *a-c*. The bottom surface of the upper float portion 40 causes the buoyant forces to rapidly build up, thereby providing positive actuation of the switch device 16 at a prescribed high liquid level 54, and to thereby stop the supply of liquid to the container when such level is reached. The actuating arm or shaft 46 has a length chosen to set the high liquid level. That is to say, the distance between the lower surface of upper float portion 40 and the upper end 48 of the shaft 46, where it contacts switch actuator lever 34, determines the high liquid level 54, and the shaft 46 comprises the major portion of such distance.

When the switch 16 is actuated into an open mode, the relay mechanism in the standard power control circuit is deenergized, thereby cutting power to the source of liquid, for example, an electrical distillation device. The liquid supply to the container is accordingly thus stopped. At this point, the switch actuation mechanism 17, through lever 34 is still exerting a downward force on the upper end 48 of the float unit, although a lesser force than that applied immediately before the switch snapped open. The float unit may rise slightly in the liquid after snapping-open the switch, and cause actuator lever of the switch to travel past the operating position (i.e. to over-travel) which is typical and does not adversely affect the operation of the level control.

Thereafter, as liquid is drained from the container, the float unit 18 will not descend with the liquid level until the liquid level lowers to a level 52 on the lower float portion 42. The switch unit 16 is selected to have a release force substantially less than the operating force. As the liquid level descends below the lower end of the upper float portion 40, the buoyant force of lower float portion 42 still exerts an upward force on the switch actuator which is greater than the release force, thus leaving the switch 16 in its open position with the liquid supply stopped. When the liquid level lowers to a predetermined turn-on level 56, somewhat below the upper end of the lower float and above the height 52 at which the float unit is buoyant in the liquid, the upward force exerted by the float unit 18 becomes less than the release force, and the contacts *b-c* of the switch 16 close, thus activating the power control to, in turn, reestablish the supplying of liquid to the container 12 through piping circuit 26.

It will be appreciated that the split or separated float unit and the snap-action switch together provide a level control which turns off an electrical liquid supply device at a first high level 54, but which does not turn the supply device back on until the liquid has descended to a second low level 56. The difference in the levels is easily selected mainly by choosing the length of the interconnecting arm 44. That is, the difference in high and low levels depends on the vertical separation of the float portions 40 and 42. The level control will thus cause the supply device to turn off and on only after a selected substantial volume of fluid has been drained, instead of causing the supply device to frequently turn off and on with small or varying changes in liquid level.

Surprisingly, the present level control device allows a difference of about 6 inches between the high and low liquid levels while the end of the lever of the switch may move only about ⅛ inch. It is apparent that a much greater difference in levels can be obtained by merely changing the dimensions and weight of the float assembly 18.

Although the present invention has been described in connection with a level control for regulating the supply of liquid to a collection and dispensing container, the invention is useful in other applications. The float unit and switch unit combination may also function as a liquid level detection system which gives indication of two separated liquid levels. The switch unit will be in an open position at a high liquid level position and in a closed position after the liquid has descended to a low level. In a detection system, the switch unit may be connected to two indicator light circuits, with the normally closed terminal being connected to one of the indicator circuits and the normally open circuit being connected to the other.

The scope of the present invention also includes the utilization of more than one combination of a float unit and switching unit. Four different liquid levels may be detected or sensed by using two such combinations in tandem.

It is of course possible to construct the float unit from a material other than glass. it is only necessary that the float unit have two floats separated by a vertical selected distance when in an operating mode, that the lower float have a volume sufficient to cause the float unit to be suspended and rise with the liquid, and that the upper float have a volume sufficient to activate the opening of the switch.

It will be understood that it is not intended that the details of the preferred embodiment set forth above be construed as limitations upon the scope of the invention, except insofar as set forth in the following claims.

We claim:

1. Apparatus for determining when at least two predetermined heights of the surface level of a liquid within a container are obtained, the apparatus comprising:

a float assembly including upper and lower float portions, means for connecting said upper and lower float portions at all times in a fixed vertically spaced apart spatial relationship, and a shaft extending upwardly from said upper float portion;

means positioned above a body of liquid for guiding the shaft portion of said float assembly, said guiding means permitting the float assembly to move upwardly and downwardly in relation to the surface level of the liquid to be determined;

normally closed switch means mounted above the upper end of the float shaft for actuation by said upper end;

said lower float portion being capable of buoyantly suspending said float assembly in said body of liquid but incapable of exerting sufficient force on said switch means to open said normally closed switch;

said upper float portion being capable of supplying sufficient force with said lower float portion to open said normally closed switch and determine an upper liquid level; and said lower float portion being capable upon the lowering of the liquid level to allow said switch means to revert to its normally closed position and thus determine a lower liquid level.

2. The apparatus of claim 1 wherein the float assembly includes a generally cylindrical lower float portion and an upper float portion having a flat bottom surface to be submerged in the liquid.

3. The apparatus of claim 2 wherein the float assembly is made from glass and is symmetrical about a vertical line.

4. The apparatus of claim 1 wherein said guiding means includes a plug portion removably engaged within an opening to container means for collecting and dispensing the liquid, said float assembly is symmetrical about a vertical axis, and the shaft portion thereof is slidably engaged within a vertical bore formed in the plug portion of said guiding means.

5. The apparatus of claim 1 wherein said switch means includes a lever positioned for engagement by the float shaft extending through a bore of said guiding means.

6. A liquid level control for use in combination with a container means for collecting and dispensing liquid and electrically powered means for supplying liquid to said container means, the level control comprising:

a float unit extending into the container means, said float unit including a lower float portion, a connecting shaft extending upwardly from the lower float portion, an upper float portion extending upwardly from the connecting shaft, and an actuating arm extending upwardly from the upper float portion;

means mounted within an opening to said container means for guiding the actuating arm of said float unit in a vertical direction; and means for switching off and on electrical power to said means for supplying liquid to said container means, said switching means including electrical contact means and means for actuating said electrical contact means, said actuating means being engaged by said float arm, said actuating means exerting a maximum force on said float arm when the contacts move from a closed position to an open position, and said actuating means exerting a lesser force on the float arm after the opening of the contacts and until the closing thereof.

7. The level control of claim 6 wherein said float unit is symmetrical about a vertical axis.

8. The apparatus of claim 7 wherein said lower float portion is generally cylindrical and said upper float portion has a bottom end provided with a flat surface portion.

9. The apparatus of claim 6 wherein said float unit is integrally made from glass and is symmetrical about a vertical axis, with said upper float portion including a bottom portion having a flat surface portion.

10. Apparatus for opening and closing an electrical circuit responsive to the level of a supply of liquid in a container, comprising: switch means for deactivating said circuit upon such liquid reaching a predetermined upper level and for reactivating said circuit upon such liquid obtaining a predetermined lower level; a float assembly moveable with the level of the liquid in said container to actuate said switch means; said float assembly including lower float means for buoyantly suspending said float assembly within said liquid but with insufficient buoyancy to actuate said switch means for deactivating said circuit, upper float means; means connecting said upper and lower float means, at all times, in a fixed spaced apart relation with each other, said upper float means for providing sufficient buoyancy in conjunction with said lower float means to actuate said switch means for deactivating said circuit upon said liquid reaching said predetermined upper level; and actuating means extending upwardly from said upper float means for operatively engaging said switch means; and said lower float providing means for permitting said switch means to reactivate said circuit upon the lowering of the level of said liquid in said container to said predetermined lower level.

* * * * *